US008132627B2

(12) United States Patent
Braddick

(10) Patent No.: US 8,132,627 B2
(45) Date of Patent: Mar. 13, 2012

(54) DOWNHOLE TUBULAR EXPANSION TOOL AND METHOD

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 243 days.

(21) Appl. No.: 12/482,538

(22) Filed: Jun. 11, 2009

(65) Prior Publication Data

US 2009/0242213 A1 Oct. 1, 2009

Related U.S. Application Data

(63) Continuation-in-part of application No. 11/803,389, filed on May 12, 2007, now Pat. No. 7,845,421.

(51) Int. Cl.
*E21B 23/08* (2006.01)
*E21B 23/00* (2006.01)
*E21B 23/04* (2006.01)

(52) U.S. Cl. ..... 166/383; 166/216; 166/217

(58) Field of Classification Search ..... 166/216, 166/217, 207, 212, 383; 175/85
See application file for complete search history.

(56) References Cited

U.S. PATENT DOCUMENTS

| | | | | |
|---|---|---|---|---|
| 5,048,606 | A * | 9/1991 | Allwin | 166/208 |
| 5,181,570 | A * | 1/1993 | Allwin et al. | 166/381 |
| 5,333,692 | A | 8/1994 | Baugh et al. | |
| 5,348,095 | A | 9/1994 | Worrall et al. | |
| 6,021,850 | A | 2/2000 | Wood et al. | |
| 6,041,858 | A | 3/2000 | Arizmendi | |
| 6,050,341 | A | 4/2000 | Metcalf | |
| 6,250,385 | B1 | 6/2001 | Montaron | |
| 7,117,940 | B2 * | 10/2006 | Campo | 166/207 |
| 2001/0020532 | A1 | 9/2001 | Baugh et al. | |
| 2005/0263292 | A1 * | 12/2005 | Braddick | 166/382 |
| 2008/0156499 | A1 * | 7/2008 | Giroux et al. | 166/380 |

* cited by examiner

*Primary Examiner* — David Bagnell
*Assistant Examiner* — Cathleen Hutchins
(74) *Attorney, Agent, or Firm* — Streets & Steele

(57) ABSTRACT

A tool 10 is provided for radially expanding a downhole tubular C, and includes a central tool mandrel 12 which functionally is part of a drill string or work string, a tubular expander 48 at the lower end of the tubular, and a downhole actuator 15 for forcibly moving the expander axially within the downhole tubular. Slips 20 are positioned for securing the tool within the tubular, so that the slips may be set, and the tool subsequently stroked to move the expander 48 and radially expand a length of the tubular. Upward pull on the work string may expand long portions of the downhole tubular.

30 Claims, 12 Drawing Sheets

DOWNHOLE TUBULAR EXPANSION TOOL AND METHOD

CROSS REFERENCE TO RELATED APPLICATION

This application is a continuation-in-part of U.S. patent application Ser. No. 11/803,389 filed on May 12, 2007, now U.S. Pat. No. 7,845,421 and claims priority from the parent application.

FIELD OF THE INVENTION

The present invention relates to tools and techniques for expanding a tubular in a well. More particularly, the invention relates to a highly reliable tubular expansion tool which may be positioned downhole and hydraulically stroked to expand a relatively short length of the downhole tubular or pulled upward from the surface to expand a long length of the downhole tubular.

BACKGROUND OF THE INVENTION

One of the problems with prior art expansion tools is that the tubular expander itself is frequently housed within an outer tubular housing which inherently has a diameter greater than the diameter of the expander. Accordingly, it is frequently difficult to position this housing with the internal expander therein at the desired location at the lower end of the tubular in a well, particularly when there is a substantial variance between the OD of the tubular expander housing and the OD of the tubular prior to being expanded.

A further significant problem with conventional tubular expander techniques is that axial movement of the tubular expander must be stopped before reaching the upper end of the tubular being expanded, since an expander under high force will tend to "shoot past" the upper end of the tubular during the expansion process, thereby resulting in an unsafe condition. Accordingly, operators typically stop upward progress of the expander before the upper end of the casing being expanded, then lower the expander in the well, then use a cutting tool to separate the uppermost portion of the tubular string which is not expanded from the portion of the tubular string which is expanded. Once the expander is removed from the well, the cut-off upper portion of the tubular string may be similarly removed from the well.

Various hydraulic expansion tools and methods have been proposed for expanding tubular while downhole. While some of these tools have met with success, a significant disadvantage to these tools is that, if a tool is unable to continue its expansion operation (whether due to the characteristics of a hard formation about the tubular, failure of one or more tool components, or otherwise), it is difficult and expensive to (a) retrieve the tool to the surface to repair the tool, (b) utilize a more powerful tool from the beginning to continue the downhole tubular expansion operation, or (c) sidetrack around the stuck expander. Accordingly, techniques have been developed to expand a downhole tubular from the top down, rather than from the bottom up, so that the tool may be more easily retrieved.

U.S. Pat. No. 5,348,095 discloses a method of expanding a casing downhole utilizing a hydraulic expansion tool. U.S. Pat. No. 6,021,850 discloses a downhole tool for expanding one tubular against either a larger tubular or the borehole. Publication U.S. 2001/0020532 A1 discloses a tool for hanging a liner by pipe expansion. U.S. Pat. No. 6,050,341 discloses a running tool which creates a flow restriction and a retaining member moveable to a retracted position to release upon the application of fluid pressure. U.S. Pat. No. 6,250,385 discloses an overlapping expandable liner. A high expansion diameter packer is disclosed in U.S. Pat. No. 6,041,858. U.S. Pat. No. 5,333,692 discloses seals to seal the annulus between a small diameter and a large diameter tubular.

The disadvantages of the prior art are overcome by the present invention, and an improved tool and technique are hereafter disclosed for expanding a downhole tubular.

SUMMARY OF THE INVENTION

In one embodiment, a tool for radially expanding the downhole tubular includes a tubular expander having a tapered outer surface for expanding the downhole tubular as the expander moves axially. A downhole actuator moves the expander axially within the downhole tubular. Buttress threads may support the tubular expander from a lower end of the downhole tubular when the downhole tubular and expander are run in the well, with the buttress threads having a tension flank that is angled downwardly and outwardly with respect to a central axis of a tool. The buttress threads release the tubular expander to move upward with respect to the downhole tubular.

In another embodiment, the tool includes a slip assembly positioned above the tubular expander for securing the tool to a downhole tubular. The tool may be picked up at the surface through the work string to release the slips after an expansion stroke. In a preferred embodiment, the downhole actuator includes a hydraulically powered drive assembly for separately setting the slips and later moving the expander axially within the downhole tubular. Improvements allow the expander to reliably move through the upper end of the tubular being expanded, since slips secure the tool axially within the well during this final expansion.

In yet another embodiment, the downhole expansion tool is utilized for a tubular drilling operation. The tubular may be rotated from the surface prior to tubular expansion, with an engageable clutch transferring torque from the tubular to lower components of the tool, which then rotate the bit or reamer to drill a hole. Once the tubular drilling operation is complete, the clutch may disengaged so that the tubular string thereafter may be rotated without corresponding rotation of the bit.

In another embodiment, a release joint or release connection is used to disengage portions of a tool which are returned to the surface from components left downhole.

These and further features and advantages of the present invention will become apparent from the following detailed description, wherein reference is made to the figures in the accompanying drawings.

DETAILED DESCRIPTION OF PREFERRED EMBODIMENTS

FIG. 1 illustrates one embodiment of a expansion tool 10 which may be used to expand a liner, casing, or other tubular C within a well. FIG. 1, as well as other figures discussed below, illustrates upper, lower, or intermediate portions of an axially elongate tool. The tubular C and the tool may be run and the tubular expanded in an uncased portion of a well, or may be run in a cased portion of a well. A particular feature of the invention is the use a downhole actuator 15, which may be hydraulically powered, to expand one or more relatively short portions of the tubular C. Thereafter, the secured engagement of the expanded portion of the tubular with the well (either an outer casing or the borehole wall) allows an axial pull on the work string which run the tool in the well to pull up on the tool and thus upon the expander to thereby expand a relatively long portion of the tubular C.

Figure 1A:
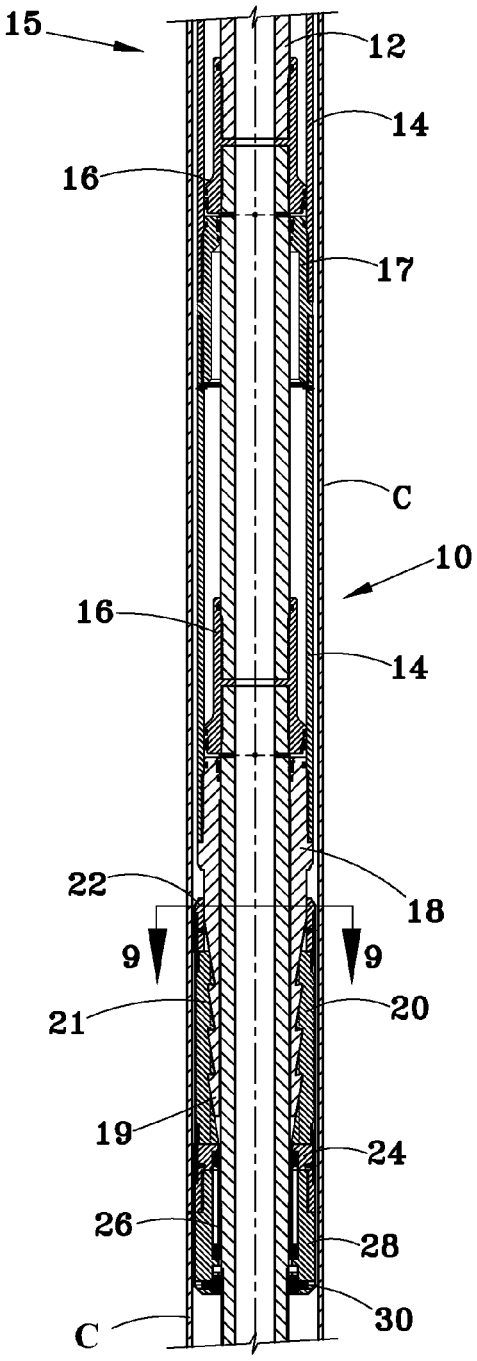
FIGS. 1A and 1B are cross-sectional views of a portion of an expansion tool positioned within a downhole tubular.
Figure 1B:
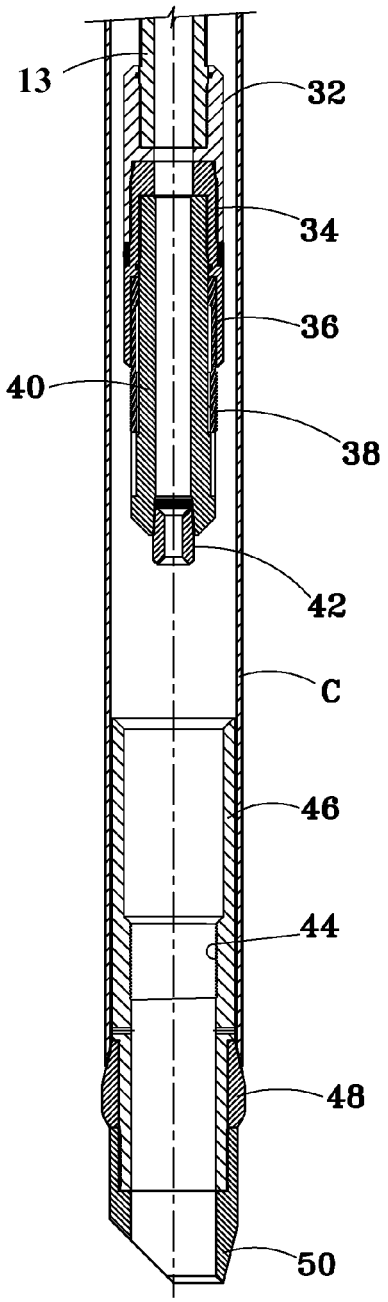

FIGS. 1A and 1B illustrates a representative portion of a drill pipe or other work string 12 which supports a tool including an actuator 15 having a plurality of pistons 16 each connected to the inner sleeve or mandrel 13, and axially sealed to the outer sleeve 14. The pistons 17 are each sealed to the mandrel 13, and are axially fixed to the outer sleeve 14. The pistons, which act to stroke the tool, are mechanically coupled to sections of the outer sleeve 14, to axially move to the outer sleeve 14. In a preferred embodiment, the downhole actuator 15 comprises a plurality of pistons each axially movable in response to fluid pressure. The actuator 15 is thus preferably double acting, exerting a downward force on the outer sleeve 14 to set the slips, and simultaneously an upward force on the mandrel 13 to move the expander through the tubular. In a preferred embodiment, one or more of the plurality of pistons is radially inward of another of the plurality of pistons when the downhole actuator is fully stroked, thereby minimizing the axial length of the actuator. The downhole actuator generates an axial setting force to set the slips, and subsequently generates an axial tension force to radially expand the downhole tubular. The same hydraulic stroking action of the tool may thus be used to set the slips and to expand a length of the downhole tubular. Further detail regarding a suitable hydraulic downhole actuator are disclosed in U.S. Pat. Nos. 7,124,829, 7,124,827, 6,814,143, 6,763,893, and 6,622,789.

Figure 10:
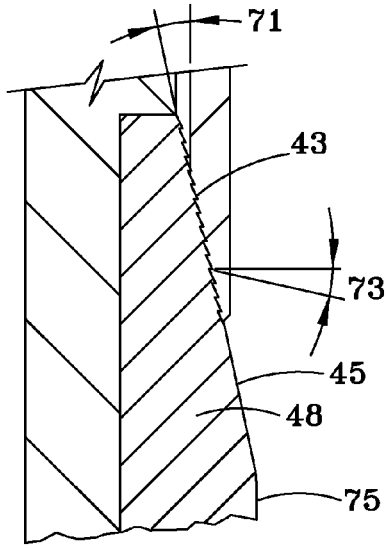
FIG. 10 illustrates in greater detail one embodiment of an interconnection of the downhole tubular and the expander.

The tubular C with expander 48 at a lowermost end thereof may first be run in a well. The tool 10 as shown in FIGS. 1A and 1B may thus be run in the well after the tubular C and expander 48 are in the well, with the tool run to a selected distance above stabilizing sleeve 46, which as shown has threads 44 on its interior surface of a restricted diameter portion. End sleeve 50 is threaded to the lower end of sleeve 46, and the wedge ring or other suitable expander 48 having a tapered outer surface is engaged with the lowermost end of the casing C, as shown in FIG. 10, and is effectively sandwiched between the lowermost end of the casing C and the upper end of end sleeve 50.

Figure 9:
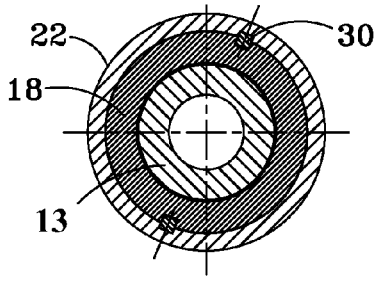
FIG. 9 illustrates a cross-sectional view along lines 9-9 in FIG. 1A.

The tool includes a setting sleeve 18 which is mechanically connected to the outer sleeve 14, and supports one or more members 19 which press the slips 20 outward when the setting member is moved downward by the actuator 15. An upper guide sleeve 22 is provided encompassing the slips 20, and is also shown in FIG. 9.

Figure 2A:
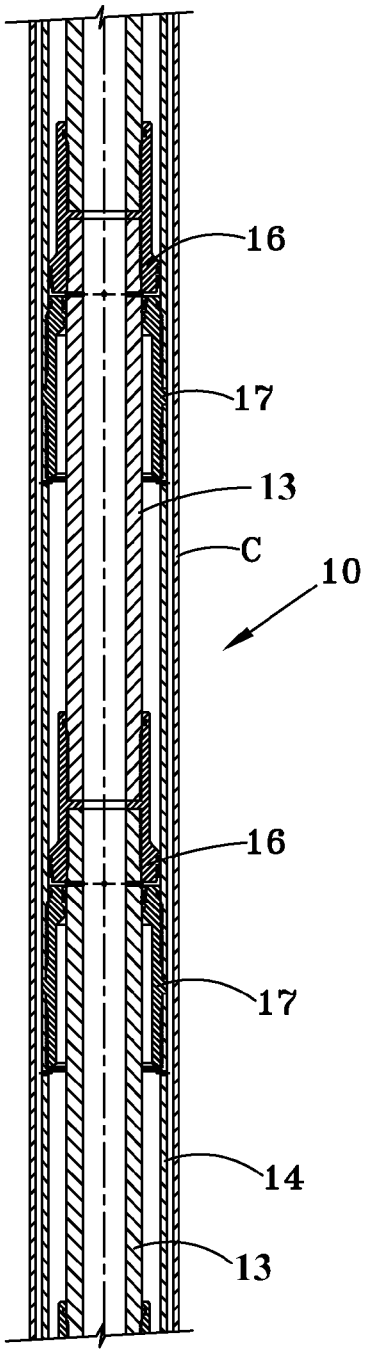
FIGS. 2A and 2B illustrate the downhole tubular and tool shown in FIG. 1 with the tool secured to the downhole tubular.
Figure 2B:
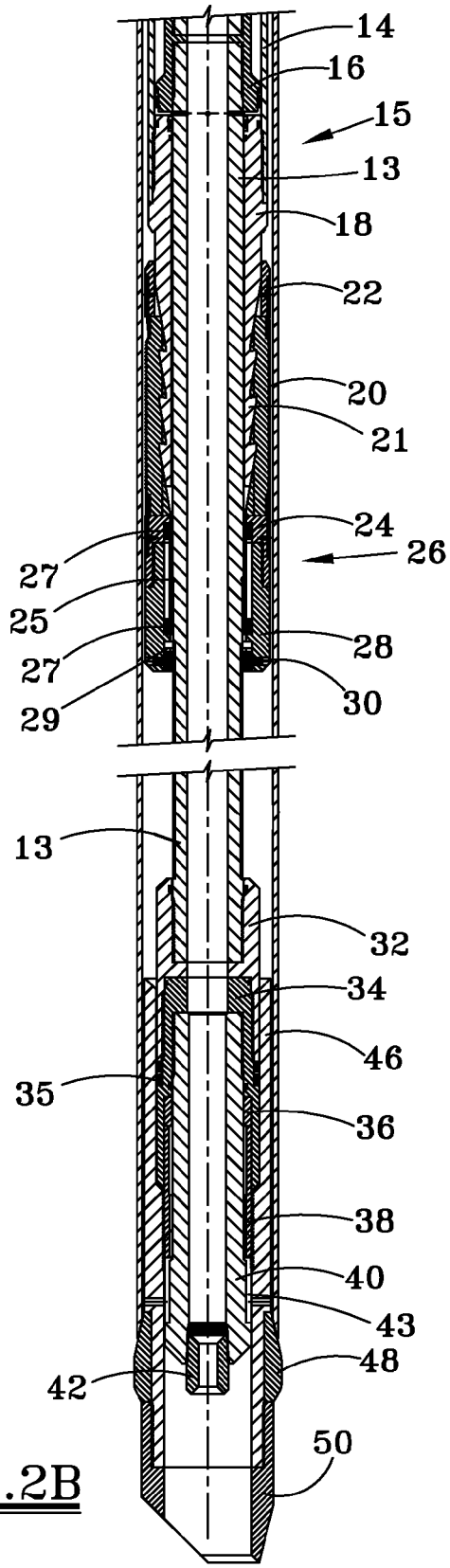

FIG. 2B illustrates the piston assembly and the slip setting assembly lowered so that the seals 35 are in sealing engagement with the sleeve 46, which acts as a stabilizer. Left-hand threads 38 and 44 as shown in FIGS. 1A and 1B and FIGS. 2A and 2B allow for latching of the tool with the sleeve 46 supported on the lower end of the tubular. In this position, the threads 38 supported on the collet member 36 as shown in FIG. 1B latch with the threads 44 on a sleeve 46 to securely latch the tool 10 within a lower end of the casing C. These left-hand threads allow right-hand rotation of the work string, if necessary, to disengage the tool from the downhole expander.

Slips 20 are prevented from moving downward due to engagement of the slips with the ring cage 28. Cage body 24 is threaded to the ring shaped cage 28, with collet mechanism 26 acting between the OD of mandrel 13 and the ID of body 24. Cage body 24 thus includes suitable windows, each for receiving a respective slip. Collet mechanism 26 includes upper and lower heads 27, and cooperate with a groove or other stop surface 25 on the mandrel 13 to prevent the slips from moving downward with the outer sleeve 14 during a slip setting operation. Keys 30 are provided at the lower end 29 of cage body 24, and slide within groove 25 provided in the mandrel 13 to limit relative rotation between the body 24 and the mandrel 13. The keys 30 are also shown in FIG. 9. Once the slips are set, the mandrel 13 may be moved upward relative to the slips during the tubular expansion operation, as shown in the figures.

Fluid may thus be transmitted down the interior of the drill pipe (work string) and the mandrel 13, and may then be discharged from the choke 42, as shown in FIG. 2B. Vent port 43 is provided for venting between the annulus 27 surrounding the mandrel 13 and the interior of tubular C and exterior of the tool as shown in FIG. 2B. From the FIG. 1 position to the FIG. 2 position, the work string and the downhole actuator 15 are lowered relative to the tubular C to latch the tool to the expander sleeve 46.

Figure 3A:
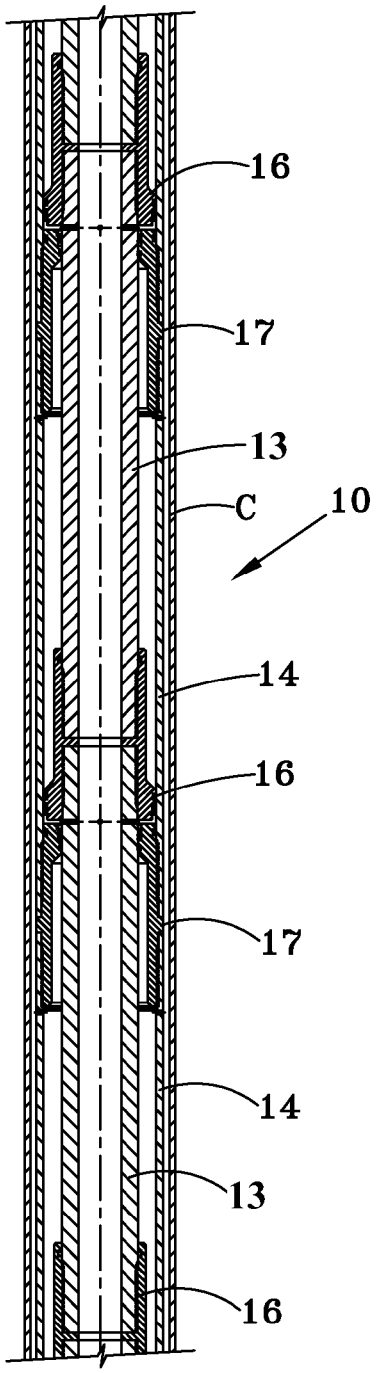
FIGS. 3A and 3B illustrate the downhole tubular and tool shown in FIG. 1 at a desired setting depth.
Figure 3B:
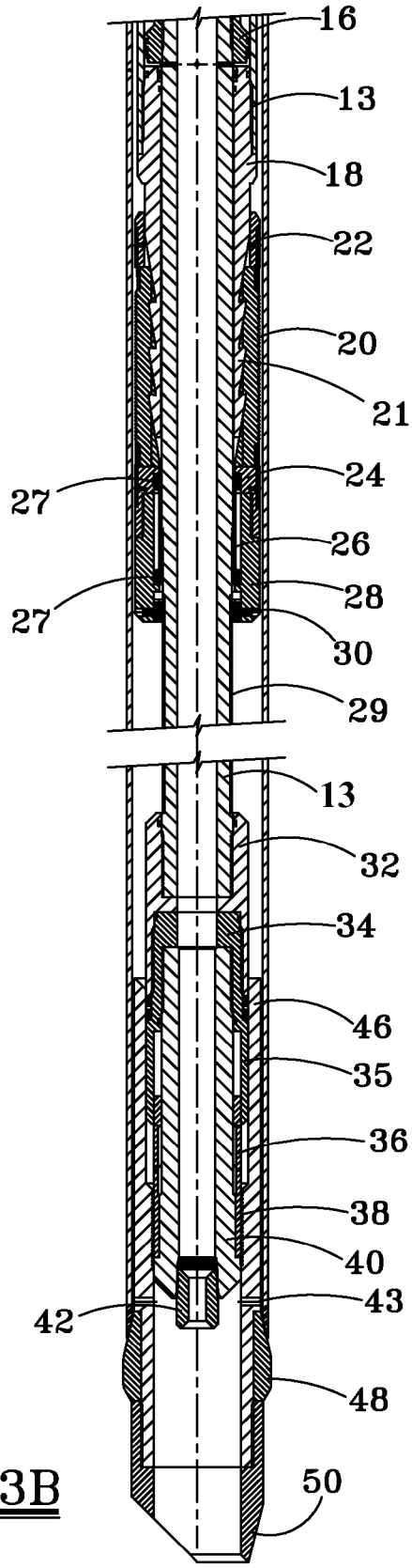
Figure 4:
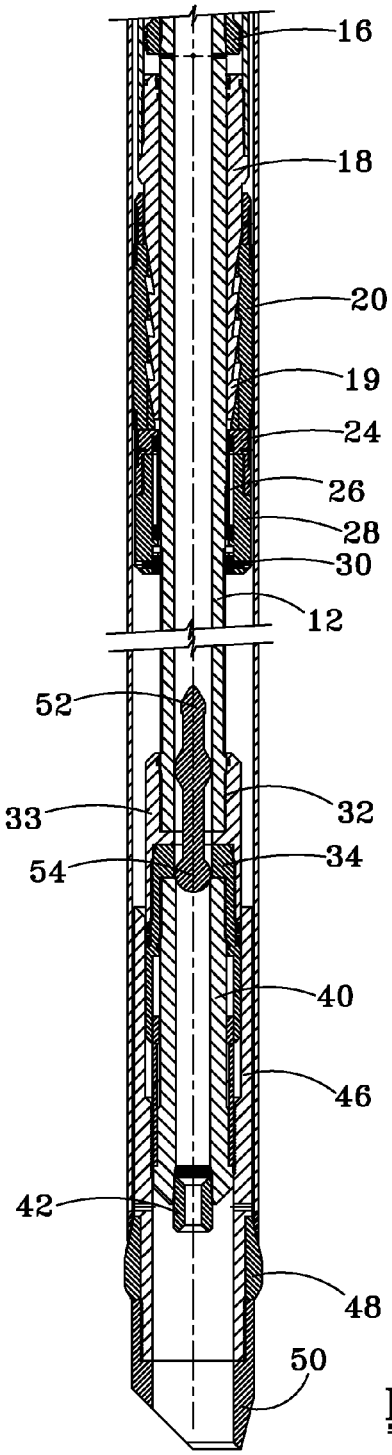
FIG. 4 illustrates the downhole tubular and tool with the ball landed to set the slips.

In FIGS. 3A and B, the casing C with the tool latched or otherwise secured thereto is run to a desired setting depth in the well. The entire tool may be picked up a short distance at the setting depth, with both the collets 26 discussed below and the slips 20 moving upward, and ports 43 then positioned below mandrel 40. The lower end 35 of seat sleeve 34 thus bottom out on the shoulder on sleeve 46 in FIG. 2B, but are raised with the mandrel 13 in FIG. 3B. FIG. 4 illustrates the lower end of the tool with a seated ball 54, which alternatively may be a plug, dart, or other closure, optionally with an upper fish neck end 52 for retrieving the ball, if necessary. The ball 54 thus lands on the mandrel 40, thereby allowing for pressure in the mandrel 13 above the seated ball to be increased. Threads 32 connect the mandrel 13 to the coupling 33, which is threaded to seat sleeve 34. Mandrel 40 is also threaded to the seat sleeve 34, and supports the choke 42.

The setting of the slips may be accomplished by setting the ball to raise the internal pressure in the mandrel 13 until the increased pressure forces the pistons 17 downward relative to pistons 16, thereby providing a high axial force to drive the setting member 18 downward. The cam surfaces on the cones 19 are driven downward relative to mating surfaces on the slips 20, forcing the slips radially outward to engage the casing C. Since a plurality of pistons are provided, the setting pressure may be relatively low for anchoring the slips and for moving the expander through the downhole tubular.

Figure 5A:
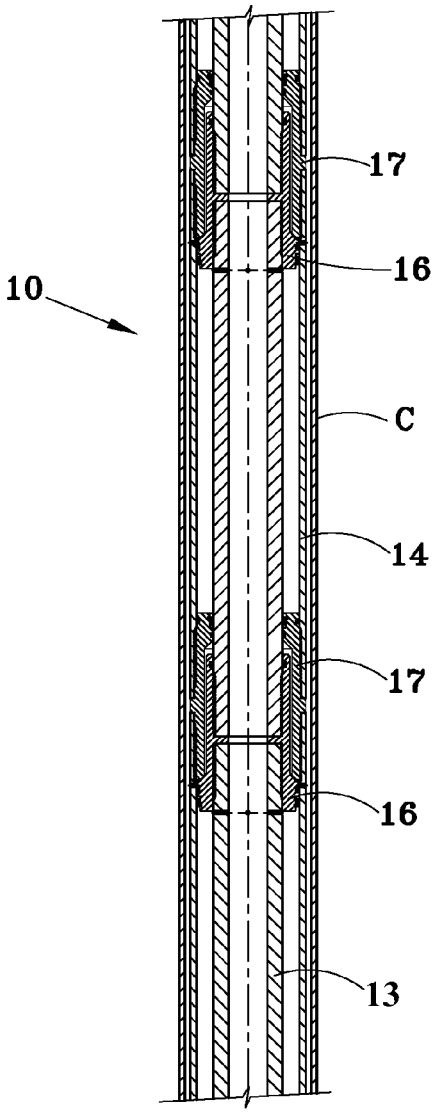
FIGS. 5A and 5B illustrate the tool expanding a first stage of the downhole tubular.
Figure 5B:
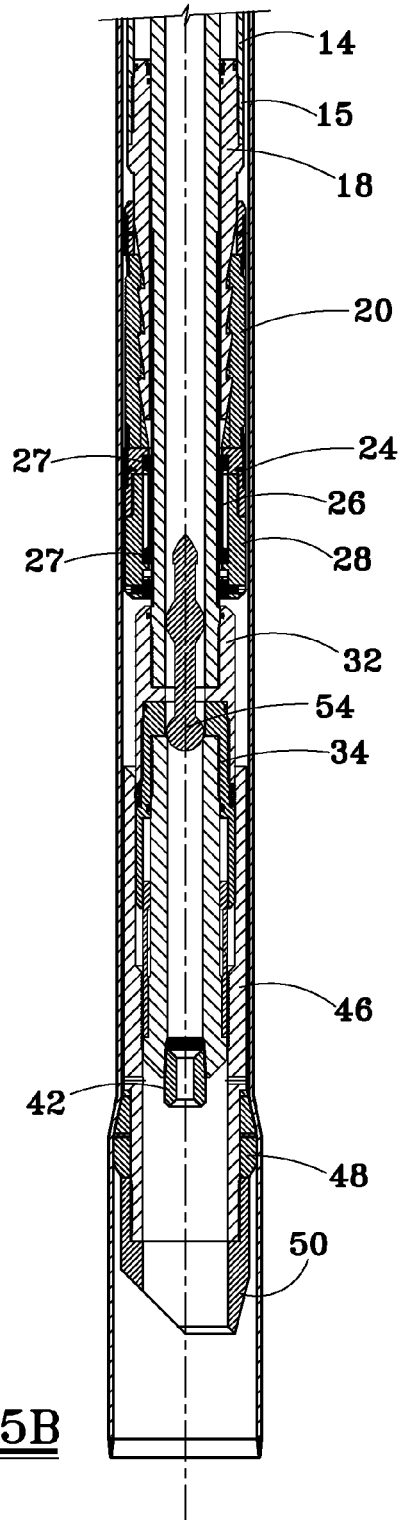

FIGS. 5A and 5B illustrate the tool hydraulically activated to expand a first portion or stage of the tubular C. Movement of the pistons 16 and thus the mandrel 13 relative to piston 17 and outer sleeve 14 pulls the mandrel 13 upward, typically in the range of from 2 to 10 feet, so that the plug 54 and seat sleeve 34 are shortly below the lower end of the cage 28. During expansion of the first stage of the tubular C, the mandrel 13 moves upward within a length of the outer sleeve 14, and maintains sealed engagement during its stroking operation with the outer sleeve 14, with the seal optionally being positioned for sealing with an intermediate sleeve fixed to either the outer sleeve 14 or the inner mandrel 13.

In many applications, the lower end of the tubular will be reliably secured within a cased or uncased well with a tubular expansion of only 5 to 30 feet. The tool may be secured with less axial expansion if expanded into engagement with a cased well. Once the lower end of the tubular has been expanded in this manner, a substantial upward force may be applied to the drill pipe at the surface (slips are unset), which is then transmitted through the mandrel 13 of the tool to the expander 48, thereby expanding the tubular C.

Figure 6A:
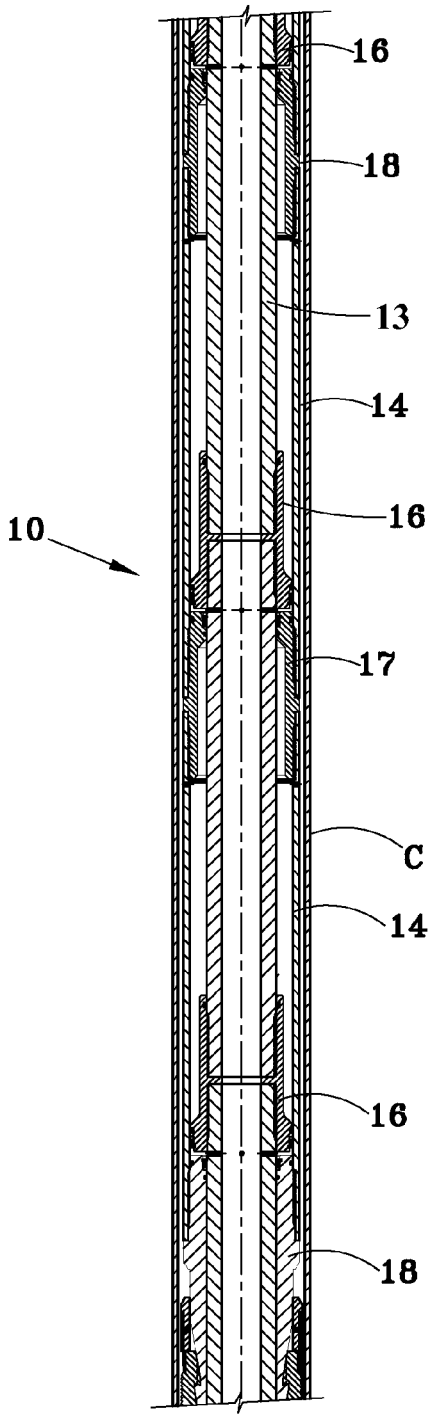
FIGS. 6A and 6B illustrate the tool in a retracting stroke after expanding a first stage.
Figure 6B:
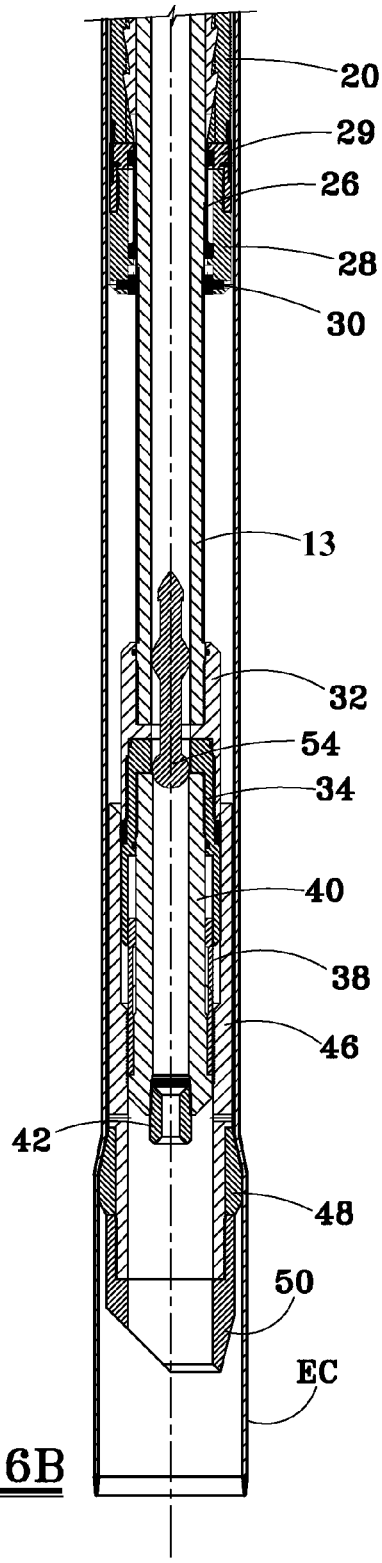

FIGS. 6A and 6B illustrate the tool 10 restroked to its initial position after the first stage expansion. During this operation, the slips are deactivated and the work string and thus the outer sleeve 14 are pulled upward a sizable length of several feet or more for another stroking operation. After stroking the tool as shown in FIGS. 6A and 6B, the slips 20 may again be set, the tool stroked during a second stage expansion, and the process repeated as desired.

Figure 7:
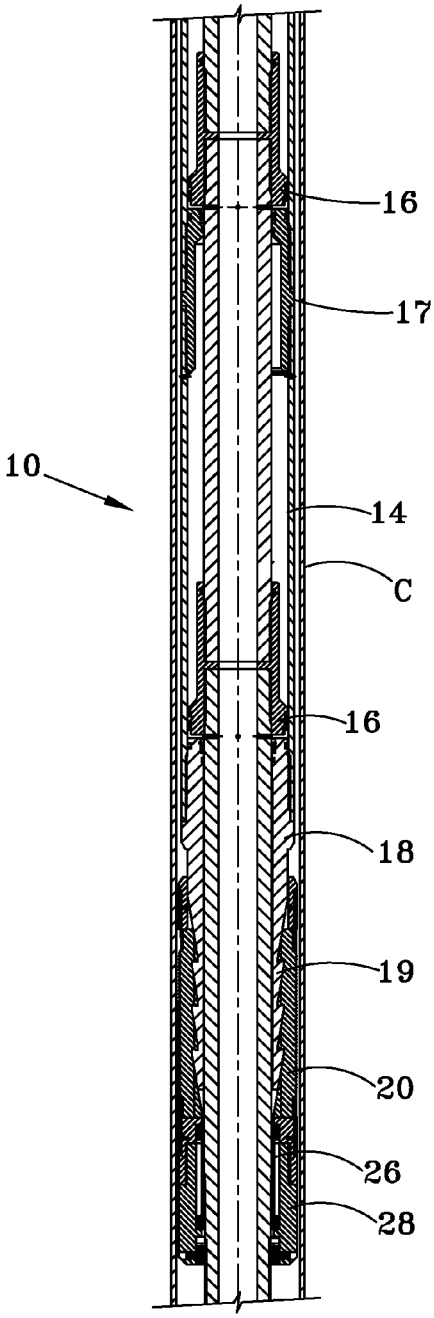
FIG. 7 illustrates the tool with the slips set to expand the second stage of the downhole tubular.
Figure 8:
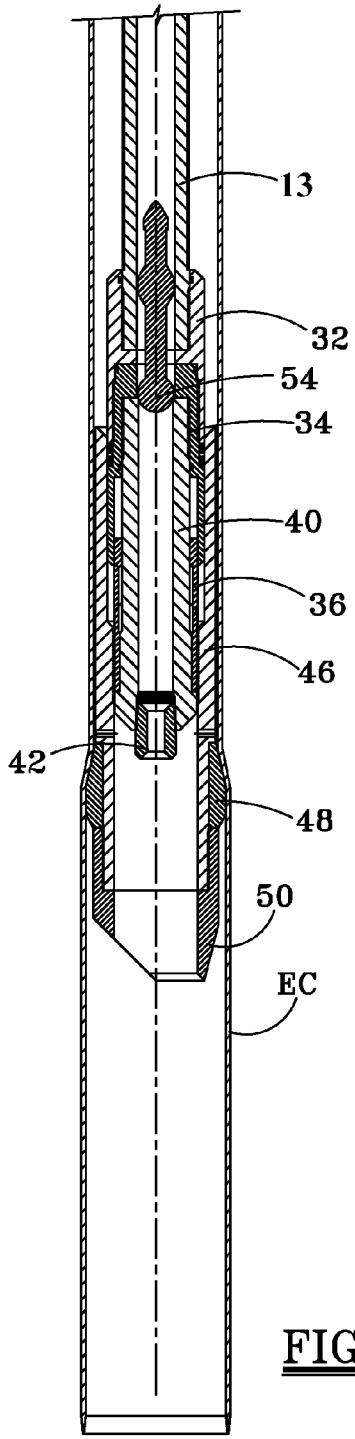
FIG. 8 illustrates a liner portion of the tool with the expander increasing the inner diameter of a portion of the casing.

FIGS. 7 and 8 show a completed second stage expansion and retraction of the slips after the tool is again stroked. The slips 20 may thus be set in a well and the expander 48 moved upward in response to the downhole actuator 15. FIG. 8 shows the ball landed on a seat within sleeve 34, and the expander 48 moved upward to expand a portion of the casing. If the expander were to become stuck in the tubular for some reason while expanding the tubular by applying tension to the drill string, and the tensile limits of the drill pipe and/or the drilling rig have been attained, the slips may be set and hydraulic pressure used to move the expander through the length of the stroke of the actuator. This process may be repeated several times, if necessary, to pass by the restriction.

In the event that the upward pull on the drill string is insufficient to expand a portion of the tubular, the tool of the present invention allows the slips to be set, and the tool hydraulically stroked one or more times, as discussed above, until the expander passes by the cause for the restriction, so that the upward pull on the string can again be used to expand hundreds or thousands of feet of tubular. The operator thus has options if the expander engages a "tight spot," since the tool may be stroked several times to overcome the restriction. The slips may thus be set in the well and the tool stroked so that the expander can reliably pass by an obstruction which resists the substantial tensile force exerted on the expander by the work string. The tensile force of a determinable amount may thus be exerted on a work string to normally pull the expander through the work string, but a substantially increased force may be generated with the downhole tool to reliably move the expander axially past any tight spot.

FIG. 9 is a cross-sectional view along the lines 9-9 in FIG. 1, and illustrates the setting sleeve 18 circumferentially secured to the upper sleeve 22 by keys 30 to limit relative rotation between setting sleeve and upper sleeve.

As shown in FIG. 10, a preferred expander has buttress threads 43 with a negative flank angle mechanically connecting the expander to a lower end of the tubular when run in the well. The buttress threads 43 as shown in FIG. 10 have a tension flank that is substantially perpendicular to or preferably is angled downwardly and radially outwardly at angle 73 with respect to a central axis of the tool. These buttress threads may safely support the tubular expander when run in the well and release the tubular expander to move axially upward with respect to the downhole tubular.

A radially outer surface 45 of the expander on which the threads 43 are formed is preferably at an angle 71 of from about 9° to about 15°, and preferably about 12°, for effectively accomplishing the desired expansion. Buttress threads preferably are at a negative angle or perpendicular to the tool central axis, meaning that the thread flanks extend radially outward and typically downwardly at a desired negative angle. A negative thread flank angle 73 is shown in FIG. 10. The expander 48 has a radially outermost surface, which may be part of a tapered surface or a short cylindrical surface 75, as shown in FIG. 10. This enables the expander to reliably attach to the tubular string, but also allows the expander to move upward past the threads when the hydraulic pistons of the downhole actuator are activated. Buttress threads are preferable for various uses over other techniques to mechanically support the expander at the lower end of the tubular. Shear pins, screws, and other mechanical connectors are less desirable since they or their receiving receptacles inherently cause stress points in the tubular, which when expanded can crack the expanded tubular, with that crack migrating upward as the expander moves upward.

In a preferred embodiment, the radial expander is a single ring-shaped member having an outer tapered surface, as discussed above. In other embodiments, the expander may comprise a plurality of collet heads at the end of collet fingers, such that the collet heads collectively form a radial expander when the collet heads are in an outward position, although the collet fingers may collapse to a reduced diameter position for retrieval. One embodiment of an expander formed from collet fingers and expander members is disclosed in U.S. Pat. No. 6,814,143.

A particular feature of the invention is that the work string and thus the setting sleeve 18 is directly tied to the outer sleeve 14, as shown in FIG. 2B. Setting sleeve 18 includes a plurality of cones 19 for sliding engagement with the slips 20, and these cones are directly tied to the outer sleeve 14 by the threads 13, as shown in FIGS. 2B and 3B. Accordingly, the outer sleeve 14 may be lowered from the surface with the mandrel 13 and the workstring, thereby lowering the setting sleeve 18 relative to the slips 20, and effectively setting the slips. Cam surfaces 21 on the slips and mating cam surfaces on the cone are thus provided for sliding engagement during setting of the slips.

The collets 26 are positioned within the cage body 28 and releaseably engage an annular groove 25 or other stop surface in the mandrel 13 to hold the slips 20 in an upward position, so that the slips do not move downward with the setting sleeve 18 when the slips are set. The collets 26 thus open radially outward after the slips are set, as shown in FIG. 5B, and reset the tool when the setting assembly is raised, as shown in FIG. 6B. The action of a collet mechanism is thus repeatable, thereby allowing the tool to be repeatedly restroked. The collets 26 may include upper and lower collet heads 27. Downward movement of the outer sleeve 14 may set the slips 20, and thereafter the slips 20 and the collets 26 may move up relative to the mandrel 13 and the expander 48 during the tool resetting stroke. The inner mandrel 13 of the tool thus moves upward with respect to the set slips 20 during expansion. After the expansion operation, the hydraulic tool may be retracted or reset so tool components return to their same position relative to the expander when the tool was initially at the setting depth. After resetting the tool and again setting the slips at a higher level in the well, the work string 12 may again be pulled to expand another portion of the tubular.

The downhole tool as disclosed herein may also be used for a clad or an uncased mono-diameter expansion operation. In this case, the downhole tubular is expanded in engagement with a second tubular that may provide upper support for an uncased tubular expansion, may provide enhanced strength to cased tubulars, or may repair tubulars which may have one or more structural defects or undesirable leaks. A setting operation involves the use of a smaller diameter tubular to be expanded into engagement with the interior of the second tubular, and forms a clad on the interior of the downhole tubular, thereby repairing the second downhole tubular, typically to a structural strength greater than that of the original second tubular.

Figure 11A:
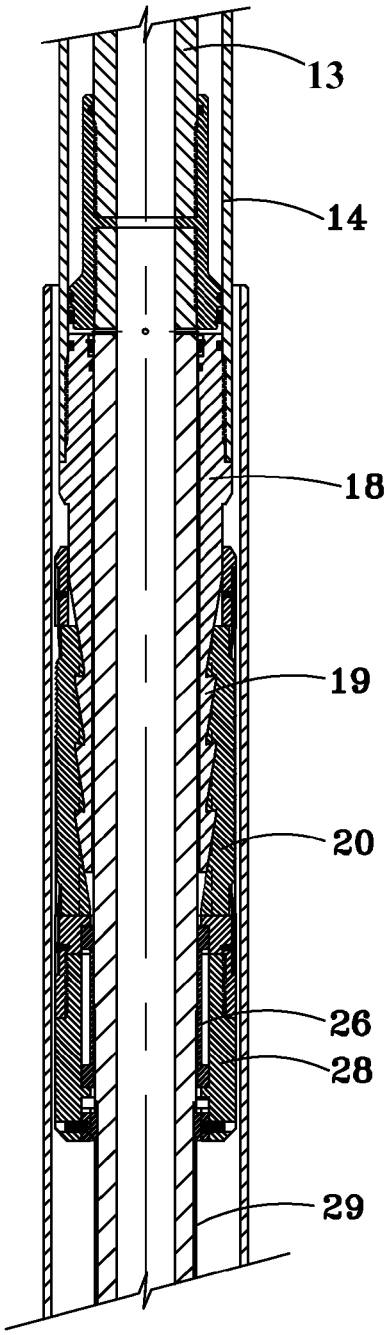
FIGS. 11A and 11B illustrate a portion of an alternative tool with slips above the expander for a clad operation.
Figure 11B:
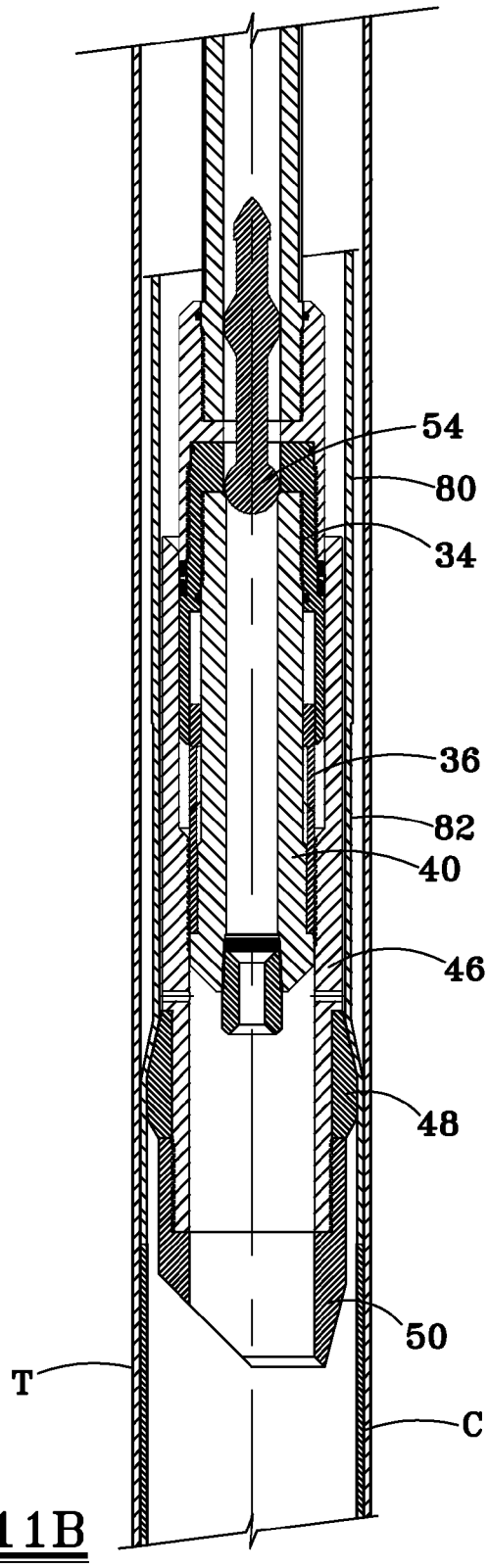

Referring to FIGS. 11A and 11B, one embodiment of the tool provides for the tubular T to be expanded into engagement with a casing C in the well during a clad operation. The inner diameter of an upper tubular section 80 as shown in FIG. 11B is preferably substantially the same as the inner diameter of tubular T prior to expansion, and the lower approximate two feet of tubular has a slightly smaller outside diameter 82 than the O.D. of the cladding above and below section 82. When nearing the uppermost end of the tubular C to be expanded, the slips 20 above the expander 48 may be set as previously discussed to reliably secure the tool in the well. The tool may then be hydraulically stroked so that the expander moves upward from below an uppermost end of the tubular to a position slightly above the uppermost end of the expanded tubular, as shown in FIG. 11B. When the expander reaches the lower end of the additional tubular section 80, which typically has a relatively short length, the upward force on the expander is reliably resisted by the downward force of the set slips 20. A shear pin or other release mechanism may connect the tubular section 80 to the expanded tubular T. When the expander 48 passes the release mechanism, engaging forces between the tubular T and the casing are very low since the reduced diameter O.D. of section 82 does not engage the I.D. of the casing. Accordingly, the upward force on the tubular from the expander shears the pins, so that section 80 moves upward with the expander, rather than being expanded. This procedure thus allows the entire length of the tubular T, including its uppermost end, to be expanded without using a cutting tool or other tool to separate a top unexpanded portion of the tubular 80 from the expanded portion of the tubular T. Once the tubular 80 is released from the expanded tubular T, i.e., by shearing the connecting pins, the entirety of the tubular 80 may be returned to the surface with the tool, while leaving the expanded tubular T or clad in place.

Figure 12:
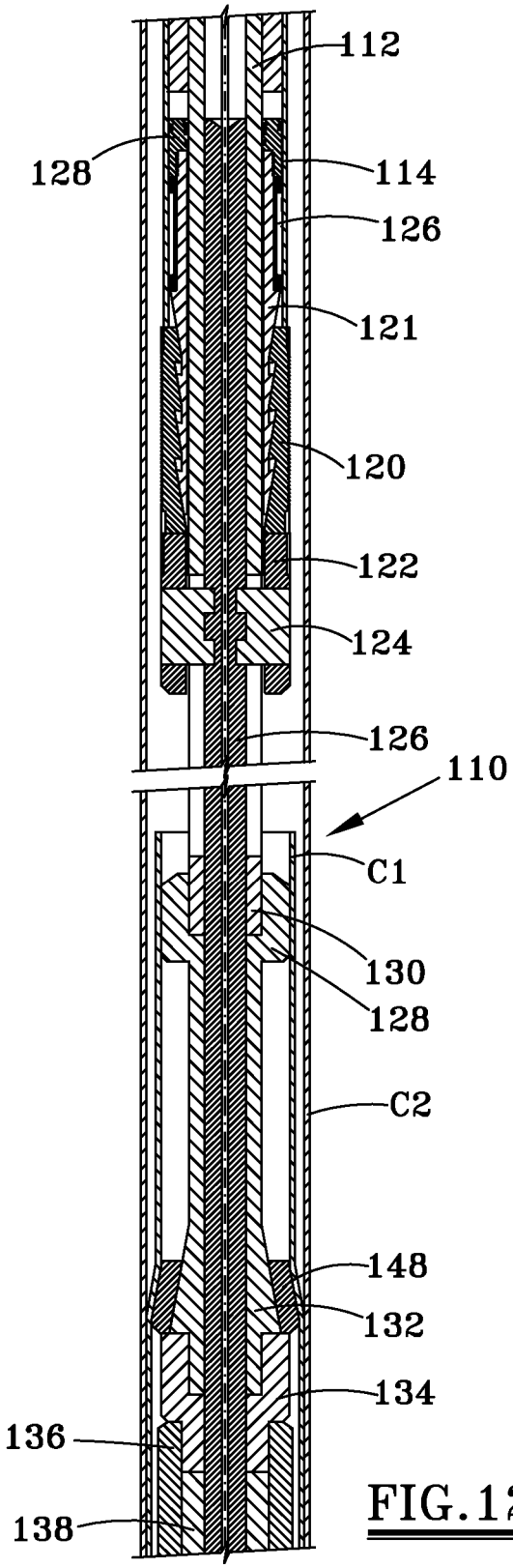
FIGS. 12 and 13 illustrate a portion of another tool with slips both above and below the expander.
Figure 13:
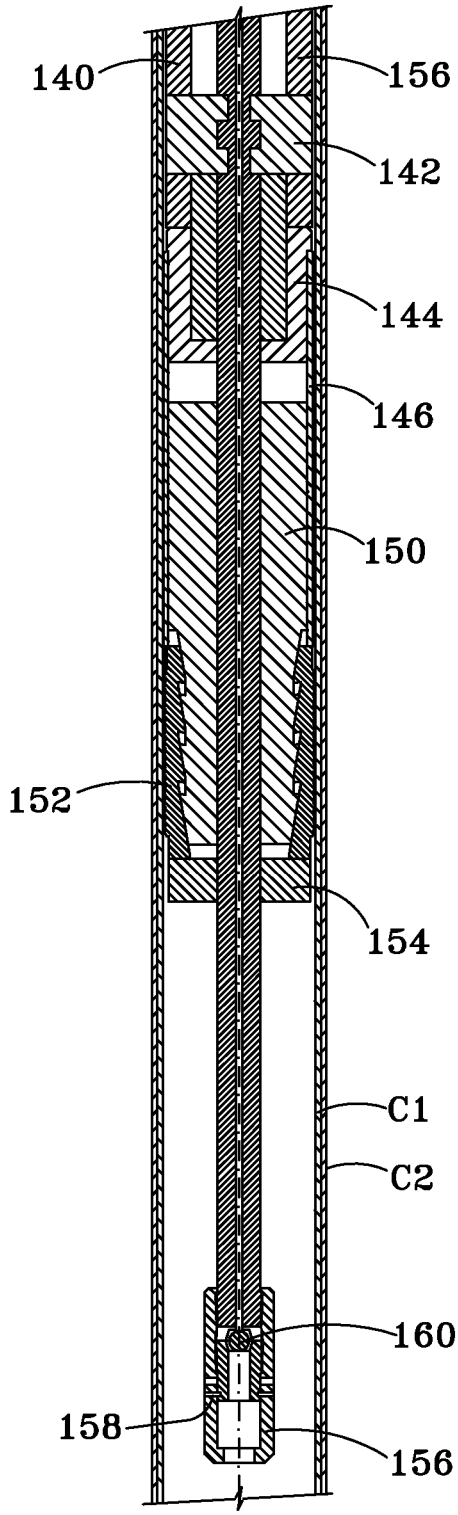

The tool as shown in FIGS. 12 and 13 utilizes an alternate concept for allowing the expander to safely pass through the uppermost end of the tubular to be expanded. For this embodiment, the tool is provided with both upper slips 120 gauged to set in the unexpanded tubular above the expander 128 and lower slips 152 gauged to set in expanded tubular below the expander. During normal operations, the hydraulic actuator tool is stroked and the cam angle for actuating the upper slips causes the upper slips to engage the unexpanded tubular C. The same motion from the actuator tool acts on the lower slips, but the lower slips normally fall short of moving radially outward to engage the internal diameter of the expanded tubular C, since outward movement of the lower slips stops when the upper slips first engage the unexpanded tubular C. When the tool reaches the top of the tubular C to be expanded, as shown in FIG. 12, the tool is expanded and the upper slips move radially outward, but there is no tubular at that axial depth to engage the slips. (Any casing radially outward of the tubular C typically has a diameter too large for engagement with the expanded upper slips.) This same axial stroking of the tool also causes the lower slips to move into engagement with the expanded portion of the tubular C, as shown in FIG. 13, thereby anchoring the tool below the expander. The expander may then be moved axially upward through an uppermost end of the tubular, the lower slips then released, and the tool returned to the surface.

Figure 14:
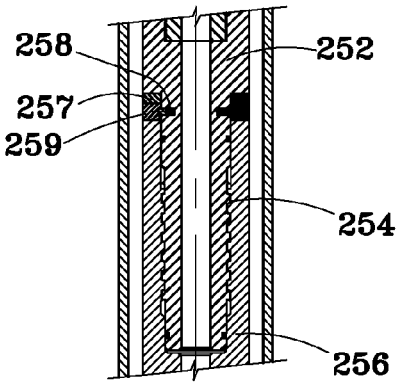
FIGS. 14 and 15 illustrate an alternate embodiment of a lower portion of an expansion tool for a tubular drilling operation.
Figure 15:
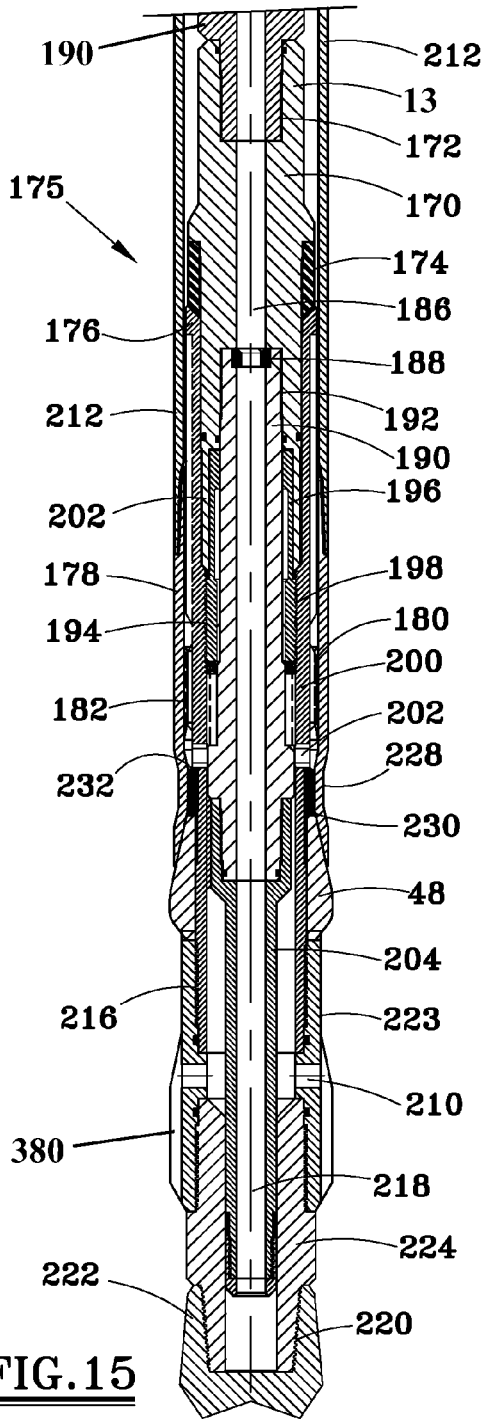

FIGS. 14 and 15 illustrate one embodiment of a lower portion of an expansion tool according to the present invention which is adapted for a liner or other tubular drilling operation. The lower portion of the tool is shown in FIGS. 14 and 15 may have an upper portion which is substantially as described above. The tubular or liner 212 with the expander 48 supported adjacent a lowermost end of the liner, the mandrel 200, and the coupling 223 and housing 224 with a bit or reamer 222 at the end thereof may first be lowered in a well affixed to the liner, then the remainder of the tool lowered so that collet heads 194 on the lowered tool connect with the threads 198 on the mandrel 200. The liner 212, once expanded, may have its upper end within a casing or other downhole tubular (not shown in FIG. 15).

Figure 16:
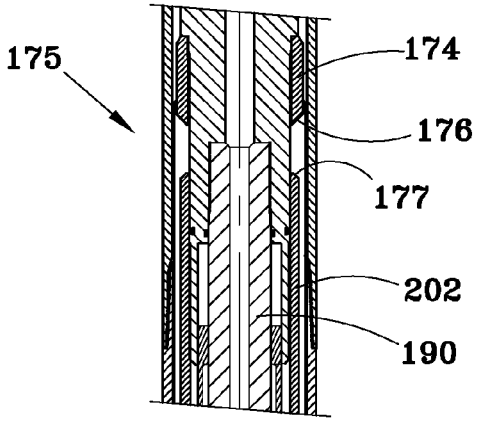
FIG. 16 illustrates the clutch in FIG. 15 disengaged.

The work string 189 is threaded at 172 to mandrel 170. Sleeve 174 is also threaded to mandrel 170, and has lower clutch jaws 176 circumferentially arranged thereon. The clutch jaws 176 mate with and thus engage clutch jaws 177 at the upper end of mandrel 200 (see FIG. 16, wherein the clutch jaws are disengaged). A radially external surface of the mandrel 200 includes axially extending splines 182, which mate with similar splines 180 on the modified liner section 178. The splines 180 on the liner section 178 similarly extend axially, and the upper and lower ends of the splines may include conventional tapers so that the mandrel 200 effectively slides along the splines while torque is transferred from the mandrel 170 to the mandrel 200, and from the mandrel 200 to the liner 212 to be subsequently expanded, thereby allowing the unexpanded liner and the tool to be rotated together as an assembly. The mandrel 170 includes a central bore 186, and a selectively sized seat 188 for subsequently receiving a ball or other plug member.

Mandrel 170 in turn is threaded at 192 to mandrel 191. When the tool is latched into the liner as shown in FIG. 15, the upper end of mandrel 200 circumferentially surrounds and is axially slidable relative to the lower end of the mandrel 170.

The upper end of mandrel 200 is thus positioned circumferentially about the lower end of mandrel 170. Collet fingers 196 with lower heads 194 are threaded at 198 to the mandrel 200 when the tool is assembled downhole, as discussed above, and may slide axially relative to mandrel 170 to allow the clutch teeth to be disengaged when the work string 12 is subsequently picked up. Flow through passages 202 extend from the inside of the liner section 212 to the exterior of mandrel 190 to allow for drainage and prevent a pressure head in the tool.

Tube 204 may thus be threaded to and sealed to mandrel 190, and accordingly moves axially with mandrel 190. Expanding members 48 are supported adjacent the lower end of liner section 178, and may be threaded to the liner section as disclosed in U.S. application Ser. No. 11/803,389, hereby incorporated by reference. Lower coupling 223 sandwiches the expander 48 between the sleeve 230 threaded to the lower inwardly formed section 228 of the liner 212 and coupling 223. For the embodiment depicted in FIG. 15, sleeve 230 may be externally threaded to internal threads on section 228 of the liner. Sleeve 230 is prevented from moving upward by engagement with shoulder 232 on mandrel 200, thereby rotating mandrel 200 and lower coupling 223. Sleeve 230 thus acts as a positive stop to prevent upward movement of the expander 48 prior to activation of the hydraulic power section of the tool. As shown in FIG. 15, the section 228 of the liner is radially inwardly formed to reduce the thickness of the sleeve 230 without increasing the thickness of the liner.

Bit or reamer 222 is threaded to the upper end of bit housing 224, which in turn is threaded to the lower end of mandrel 200. Lower threads 220 on housing 224 are provided for conventionally receiving a bit or reamer 222 for drilling the hole in response to liner rotation. Tube 204 thus includes a central bore about axis 218 which supplies fluid to the bit 222. Tube 204 remains sealed to the housing 224.

To conduct a tubular drilling or reaming operation, the tool as shown in FIGS. 14 and 15 may be positioned within the liner 212 after the liner is run at least partially in the hole, then the liner and the tool lowered to a drilling depth. When the tool is subsequently picked up, fluid from within the interior of the tool may drain out through the ports 202 in housing 222, so that the entire column of fluid does not have to be lifted to the surface with the tool. A seal between tube 204 and the housing 224 ensures the supply of a high pressure fluid to the bit 222 when the tool is positioned as shown in FIG. 15. Torque may thus be transferred through the clutch jaws when engaged to rotate the mandrel 200 and thereby rotate the bit 222. A drill string or other work string 12 may be rotated at the surface to transmit torque to the tool. When performing this operation, the string 12 is rotated, and thus rotating the mandrel 170. The engaged clutch 175 and the engaged splines 180, 182 allow rotation of the liner 212 with the work string. Suitable torque control surfaces on the clutch jaws transfer torque to the mandrel 200. Rotation of the mandrel 200 is transmitted downward past the expander 48, and to the coupling 223 and housing 224. The expanders 14 may thus each be sandwiched between the coupling 223 and the sleeve 230. By picking up on the work string, the clutch 175 may be disengaged, thereby allowing release to the surface of components above the clutch while leaving downhole components below the clutch.

The mandrel 200 which surrounds the lower end of mandrel 170 may be threaded at 216 to coupling 223. Mandrel 190 is rotated with the mandrel 170, thereby also rotating tube 204. Torque is transmitted from the mandrel 200 to the bit or reamer 222 without torque having to be transmitted through the expander 48.

FIG. 14 also illustrates an optional mechanism for releasing the tool from the work string in the event that a conventional release cannot be obtained. A short mandrel 252 may be provided at the lower end of the work string and above the assembly shown in FIG. 15. This mandrel may include right hand threads 254 which mate to the similar threads on mandrel 256, which in turn may be threadably connected directly to mandrel 170 shown in FIG. 15. Mandrel 252 as shown in FIG. 14 is fitted with a plurality of friction rings 257, 259 to reduce break-out torque, and cooperate with radially outward spring biased retaining pins 258. To break the connection shown in FIG. 14, left hand torque may be transmitted through the drill string, thereby allowing unthreading of the connection at a torque significantly less than that normally required to break apart one of the joints in the work string. Suitable seals may be used to maintain sealing integrity between the work string and the mandrel 170 prior to breaking apart of the connection.

Figure 17:
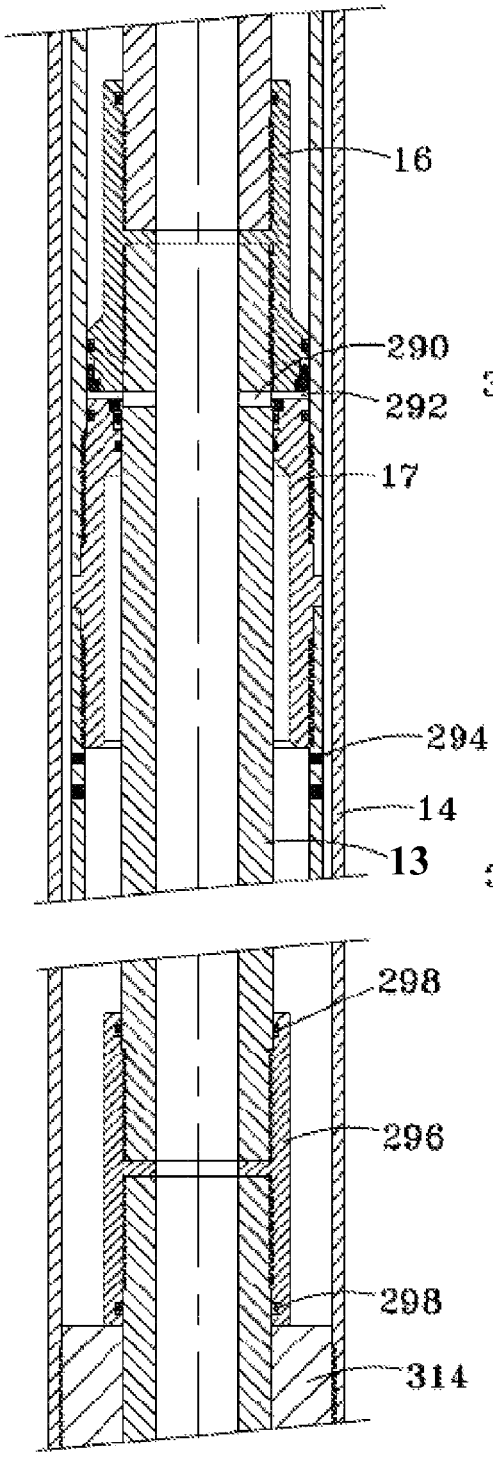
FIG. 17 illustrates an upper portion of another embodiment of a tool including a power section.
Figure 18:
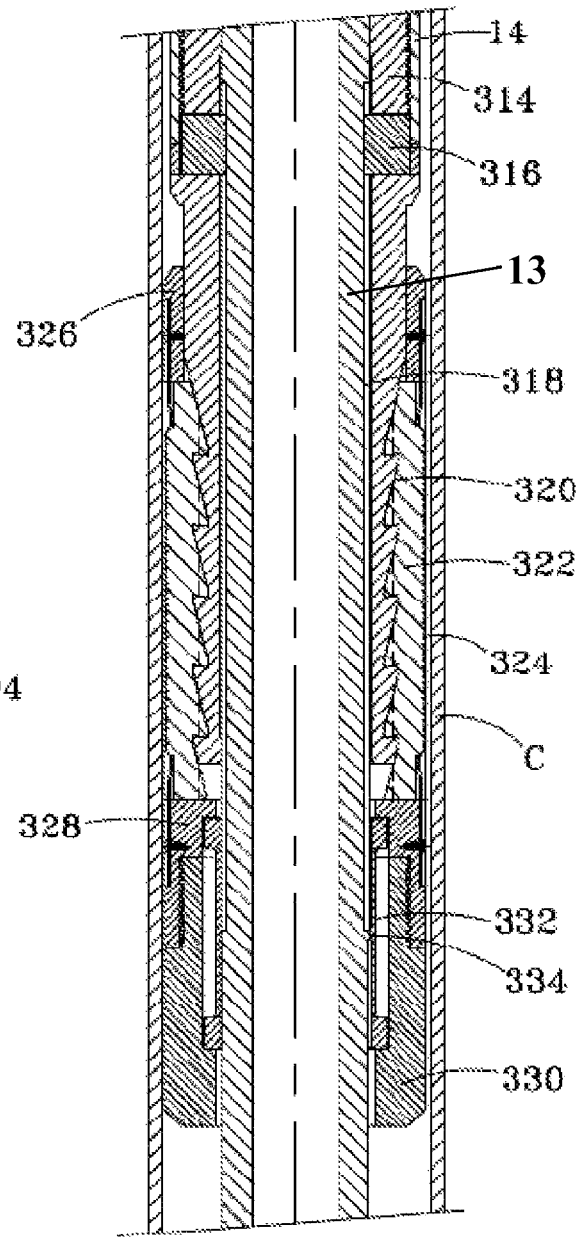
FIG. 18 illustrates a lower slip portion of the tool.

FIGS. 17-20 depict another version of an expansion tool with inner and outer pistons as shown in FIG. 17 for axially stroking a mandrel relative to an outer sleeve. More particularly, FIG. 17 discloses an inner piston 16 threadably connected to the mandrel 13, with an outer seal for sealing engagement with the outer sleeve 14. FIG. 17 also depicts an outer piston 17 threaded to the outer sleeve 14, with an inner seal for sealing engagement with the mandrel 13. The mandrel 13 includes a throughport 290 for passing fluid from the interior of the mandrel to the gap 292 between a lower end of the inner piston and an upper end of the outer piston. Those skilled in the art appreciate that the power section of the tool may include a plurality of the stacked inner and outer pistons for combining to produce a high axial force. A plurality of ports 294 are provided in outer sleeve 14 for fluid evacuation above the pistons as the tool is stroked. At the lower end of FIG. 17, coupling 296 is shown with seals 298 for sealing with a lower end of mandrel portion 13 while a lower end of the mandrel portion 13 extends through the tool anchoring mechanism, as shown in FIG. 18.

Multiple sets of pistons are also used in this embodiment for both setting the slips and moving the expander. FIG. 17 depicts an inner sleeve or mandrel 13, and an outer sleeve 14 positioned about the inner sleeve. The pistons seal with the mandrel and the outer sleeve, as discussed above. Slip actuator 314 is threadably connected to the outer sleeve 14. Torque blocks 316 are fitted in pockets between upper and lower portions of slip actuator 314, with the inner portion of blocks 316 sliding within a respective elongate slot or splined groove 318 in a mandrel 13 to rotatably connect the mandrel 13 and the slip actuator 314. The torque blocks 316 thus transfer rotational torque from the outer sleeve 14 to the inner mandrel 13, and then to the downhole assembly at the lower end of the tool, which conventionally includes a bit, such as bit 370 shown in FIG. 20. The bit is thus rotated to drill a portion of the well before the casing or other tubular is expanded. The slip actuator 314 also includes a plurality of tapered surfaces 320 which engage similar tapered surfaces on slips 322, which have outer teeth 324 for engaging the casing or other tubular to be expanded.

When the inner and outer pistons are actuated, the actuator 314 and thus the surfaces 320 move downward relative to the slips 322, which are axially spaced between upper slip sleeve 326 and lower slip sleeve 328, which is axially connected to the mandrel 13 at this stage, as explained subsequently. Collet assembly 330 includes a plurality of circumferentially spaced slots 332 with projection 334 fitting within a corresponding annular groove to axially interconnect the mandrel 13 and collet assembly 330 and thereby prevent premature movement of the collet assembly 330 with respect to mandrel 12. Actuation of the pistons moves the slips radially outward into gripping engagement with the tubular, which is not yet expanded, as discussed above. The subsequent actuation of the pistons moves the mandrel 13 upward relative to the set slips, releasing the connection between the annular slot and the projection 334, and thus moving body 352 and the expander 48 upward to expand the tubular.

Figure 19:
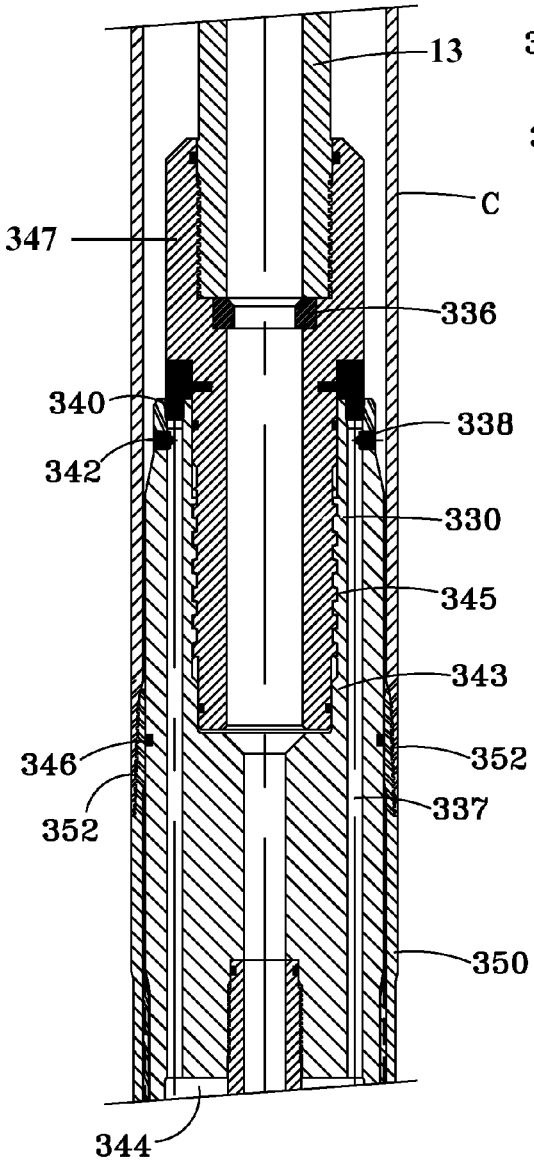
FIG. 19 illustrates another portion of the tool shown in FIG. 18, with a safety joint connecting the mandrel to the expander assembly.
Figure 20:
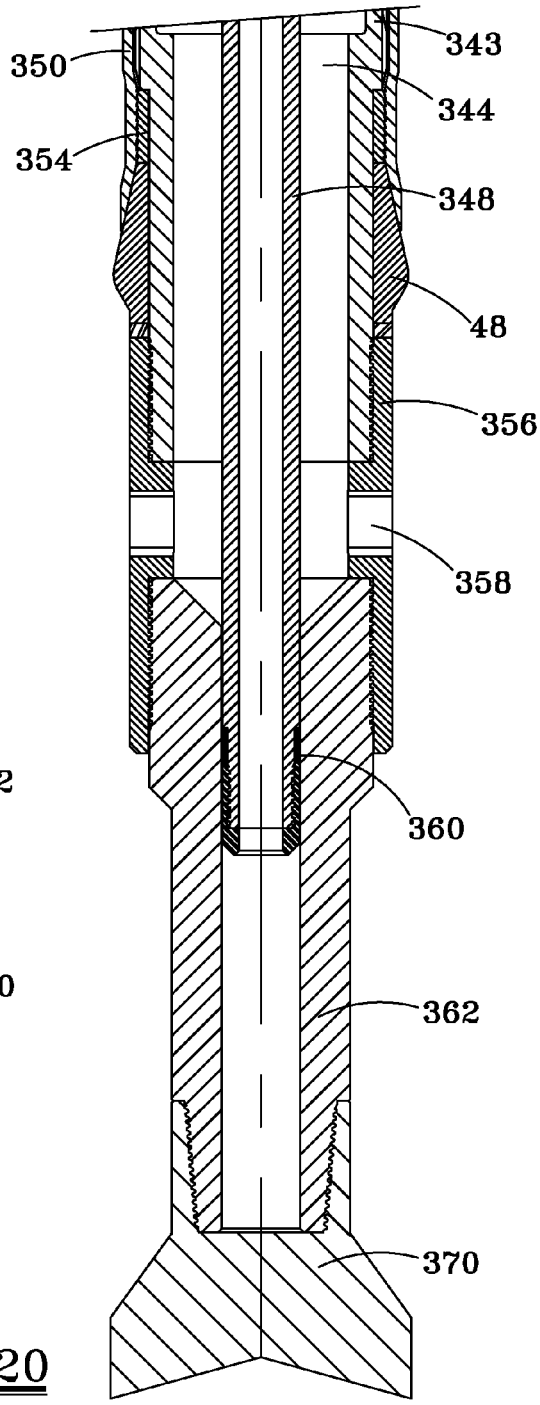
FIG. 20 illustrates a lower portion of the tool shown in FIGS. 17-19, including the expander at the lower end of a tubular for pumping cement to the exterior of the tool, and a bit or reamer for drilling and/or reaming the expandable tubular into position prior to expansion.

As shown in FIG. 19, the mandrel 13 is connected to a right-hand joint 347, which contains threads 345 for engagement with similar threads on the joint 343. Seat 336 as shown in FIG. 19 is positioned on the joint 347 for receiving the ball to increase pressure to the pistons. Joint 343 includes a plurality of vertical through passageways 337 and optionally interconnecting horizontal passageways 338, with each passageway optionally including plugs 340, 342 as shown. In order to allow fluid to be drained from within the annulus between the mandrel and the casing, the plugs 340 and 342 may be removed so that drainage through these passageways continues to the chamber 344 and thus through ports 358 to the exterior of the tool, as shown in FIG. 20. In the event that cement or other fluid is to be pumped around the tubular before it is expanded, plugs 340 and 342 may be in place as shown, with seal 346 as shown in FIG. 19 preventing fluid from moving upward into the chamber between the casing and the mandrel 13 and above the safety joint. Once cement is pumped through the bottom hole assembly and surrounds the casing to be expanded, expansion of the tubular extension 350 at the lower end of casing C will break seal 346 since the I.D. of the casing C is expanded, thereby providing a flow channel between the exterior of joint 360 and the interior of the expanded tubular, so that fluid may bleed off the cavity between the mandrel 13 and the unexpanded tubular.

In the event the expander 48 becomes stuck in a well, the majority of the tool including the inner and outer pistons and the slip assembly may be returned to the surface by left-hand rotation of the work string, with this connection preferably having a breakout torque of approximately one half of the torque used to make up the connection. This left-hand rotation will thus break the thread 345, separating the joint 360 from the joint 343, and allowing the components above the joint 343 to be returned to the surface. This safety joint also allows the bottom hole assembly, the components below sub or joint 343, and the casing to be expanded to be positioned as a subassembly in a well, then the components of the tool above joint 343, including the slip assembly and the hydraulic pistons, connected to joint 343 to complete the assembly.

The lower portion of joint 343 is threaded to coupling 356, which is threaded to housing 362. Tubular extension 350 may be threaded to the lower end of the casing or liner at 352. Ring 354 with buttress threads may axially connect the lower end of the extension 350 to joint 343, while coupling 356 is threaded to the lower end of joint 343, as shown in FIG. 19. Joint 360 at the lower end of tube 348 seals the exterior of tube 348 to housing 362, so that all fluid passed through the lower end of mandrel 13 continues to the bit 370 or bottom hole assembly.

FIG. 19 depicts another feature of the invention, wherein it may be seen that the structure of the sleeve shaped body 352 provides stabilization in the expander assembly. The degree of stabilization will to some extent depend on the length of the sleeve, although it is important that the difference between the O.D. of sleeve 352 and the I.D. of the tubular prior to expansion should be less than 0.020 inches, so the radial thickness of the gap will be less than 0.010 inches, and in many cases less than about 0.030 inches. In a preferred embodiment, the radial gap is less than about 0.035 inches, thereby providing substantial stabilization for the expander. Due to stabilization of the expander, its axis tilts very little compared to the central axis of the tool, and thereby prevents problems associated with forming an elliptical rather than a round expanded tubular. Such problems include but are not limited to lower collapse strength compared to an expanded round tubular. FIG. 15 also depicts a finned stabilizer 380 supported on coupling 223, which helps to centralize the expander 48 in the well when the tool is returned to the surface, then restabbed back to components left downhole by re-connecting threads 345.

The tool as disclosed herein may be recocked during an upward stroking operation, then the hydraulic section activated to set the slips and to pull up on the expander and expand a length of the tubular. The tool may be used to expand a tubular in an open hole operation, and may also be used to press a tubular tightly against the wall of another tubular or the formation in a cladding operation. Moreover, the technique is able to reliably expand overlapping joints of pipe sections which are expanded, thereby providing a monodiameter or continuous ID bore application.

The expansion technique disclosed herein may be used for various downhole operations, including isolation of depleted formations, overcoming lost circulation problems in a well, or providing a conduit for installation of long reach well completions. A bit or reamer preferably is provided at the lower end of drill, so the borehole can be drilled while the tubular is positioned in place, then the expander subsequently expanded to expand the tubular to the desired interior diameter. Since the expanded string is not used as conduit for the pressurized source to power the tool, there is no risk of the expanded tubular being burst by the requirements of the pressurized fluid. The tubular expanded by the present invention may have a tensile strength and a yield strength which is substantially greater than the unexpanded tubular due to cold working.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A tool for positioning in a well from a work string to radially expand a tubular after rotating the tubular to drill at least a portion of a well, comprising:

a central tool mandrel with a fluid passageway therein;

a tubular expander having a generally tapered outer surface for radially expanding the tubular as the expander is moved upward within the tubular;

slips for securing the tool within the tubular;

a downhole actuator for forcibly moving the tubular expander axially upward within the tubular, the downhole actuator generating an axially downward setting force on a setting sleeve surrounding the tool mandrel and connected to the work string to set the slips and generating an axially upward tensile force on the mandrel to radially expand the tubular; and a clutch for selective rotational engagement of the tool mandrel, the clutch when engaged transferring torque from the setting sleeve to the tool mandrel and to the bit to drill the at least a portion of the well.

2. The tool as defined in claim 1, wherein the downhole actuator comprises the plurality of pistons each axially moveable relative to the tool mandrel in response to fluid pressure within the tool mandrel.

3. The tool as defined in claim 2, wherein the plurality of pistons both move the setting sleeve downward to set the slips, and subsequently move the tool mandrel upward to expand the tubular while the slips are set.

4. The tool as defined in claim 1, further comprising:
axially elongate splines on a tool mandrel for transferring torque from the setting sleeve to the tool mandrel.

5. The tool as defined in claim 1, further comprising:
a bit or reamer supported below the tubular expander for drilling a borehole.

6. The tool as defined in claim 1, wherein the tool maintains a substantially sealed bore between the interior of the work string and the bit or reamer.

7. The tool as defined in claim 1, wherein a port extending radially through the tool mandrel above the tubular expander exposes an interior of the tubular expander to an interior of the tubular.

8. The tool as defined in claim 1, further comprising:
a right hand threaded connection along the work string for separating the tubular expander from the work string.

9. A tool for radially expanding a tubular, comprising:
a central tool mandrel with a fluid passageway therein;
a tubular expander having a generally tapered outer surface for radially expanding the tubular as the expander is moved within the downhole tubular;
a downhole actuator for forcibly moving the tubular expander axially within the downhole tubular;
slips positioned above the tubular expander for securing the tool to the downhole tubular;
the downhole actuator generates an axially downward setting force on a setting sleeve surrounding the tool mandrel and connected to the work string to set the slips and generates an axially upward tensile force on the tool mandrel to radially expand the downhole tubular; and
a clutch for selective rotational engagement of the setting sleeve and the tool mandrel, the clutch transferring torque from the setting sleeve to the tool mandrel.

10. The tool as defined in claim 9, further comprising:
axially elongate splines on a tool mandrel for transferring torque from the setting sleeve to the tool mandrel.

11. The tool as defined in claim 9, further comprising:
a bit or reamer supported below the tubular expander for drilling a borehole.

12. The tool as defined in claim 9, wherein the slips are disengaged from the downhole tubular by pulling upward on the work string suspending the tool in the well.

13. A method of radially expanding a tubular, comprising:
providing a central tool mandrel with a fluid passageway therein;
positioning a tubular expander on a lower end of the tubular;
running the tubular and the tubular expander in a well;
the tubular expander having a radially outermost surface positioned below a lower end of a downhole tubular, the radially outermost surface having a diameter greater than the initial inner diameter of the tubular when run in the well, and a radially inner portion of the tubular expander being positioned radially within a portion of the downhole tubular when run in the well;
providing slips above the tubular expander for engaging the tubular;
providing a downhole actuator for generating an axially downward setting force on a setting sleeve surrounding the tool mandrel and connected to the work string to set the slips and generating an axially upward tensile force on the tool mandrel to radially expand the tubular;
providing a clutch for selective rotational engagement of the setting sleeve and the tool mandrel, the clutch selectively transferring torque from the setting sleeve to the tool mandrel; and
thereafter positioning the downhole actuator within the well for forcibly moving the expander axially within the downhole tubular.

14. The method as defined in claim 13, further comprising:
providing axially elongate splines on the tool mandrel for transferring torque from the setting sleeve to the tool mandrel.

15. The method as defined in claim 13, further comprising:
supporting a bit or reamer below the tubular expander for drilling a borehole.

16. The method as defined in claim 13, further comprising:
providing a right hand threaded connection along the work string for separating the tubular expander from the work string.

17. The method as defined in claim 13, further comprising:
powering the plurality of pistons to both move the setting sleeve downward to set the slips, and subsequently move the tool mandrel upward to expand the tubular while the slips are set.

18. A tool for positioning in a well from a work string to radially expand a tubular, comprising:
a central tool mandrel with a fluid passageway therein;
a tubular expander having a generally tapered outer surface for radially expanding the tubular as the expander is moved upward within the tubular;
slips for securing the tool within the tubular;
a downhole actuator for forcibly moving a tool mandrel axially relative to an outer sleeve exterior of the tool mandrel, thereby moving the expander axially upward within the tubular to expand the tubular, the downhole actuator including a plurality of pistons each supported on one of the tool mandrel and the outer sleeve and sealed to the other of the tool mandrel and the outer sleeve, the downhole actuator generating an axially downward setting force on a setting sleeve surrounding the tool mandrel and connected to the work string to set the slips and generating an axially upward tensile force on the tool mandrel to radially expand the tubular;
the work string selectively rotating the outer sleeve; and
one or more locking members rotationally interconnecting the outer sleeve and the tool mandrel, such that rotation of the outer sleeve rotates a bit at the lower end of the tool mandrel.

19. The tool as defined in claim 18, wherein the outer sleeve is mechanically connected to a slip actuator, such that axial movement of the outer sleeve sets the slips into engagement with the tubular.

20. The tool as defined in claim 18, wherein the outer sleeve is keyed to the tool mandrel.

21. The tool as defined in claim 18, further comprising:
a bit or reamer supported on the tool mandrel for drilling a borehole.

22. The tool as defined in claim 18, further comprising:
a right hand threaded connection along the work string for separating the tubular expander from the work string.

23. The tool as defined in claim 18, wherein the plurality of pistons both move the setting sleeve downward to set the slips, and subsequently move the tool mandrel upward to expand the tubular while the slips are set.

24. A tool for radially expanding a tubular, comprising:

a central tool mandrel with a fluid passageway therein;

a tubular expander having a generally tapered outer surface for radially expanding the tubular as the expander is moved within the downhole tubular;

a downhole actuator for forcibly moving a tool mandrel axially relative to an outer sleeve exterior of the tool mandrel, the downhole actuator including a plurality of pistons each supported on one of the tool mandrel and the outer sleeve and sealed to the other of the tool mandrel and the outer sleeve;

slips positioned above the tubular expander for securing the tool to the downhole tubular;

the downhole actuator generates an axially downward setting force on a setting sleeve surrounding the tool mandrel and connected to the work string to set the slips and generates an axially upward tensile force on the tool mandrel to radially expand the downhole tubular;

rotation of the work string selectively rotating the outer sleeve; and one or more locking members rotationally interconnecting the outer sleeve and the tool mandrel, such that rotation of the outer sleeve rotates a bit at the lower end of the tool mandrel.

25. The tool as defined in claim 24, further comprising:

axially elongate splines on the tool mandrel for transferring torque from the setting sleeve to the tool mandrel.

26. The tool as defined in claim 24, further comprising:

a right hand threaded connection along the work string for separating the tubular expander from the work string.

27. The tool as defined in claim 24, wherein the plurality of pistons both move the setting sleeve downward to set the slips, and subsequently move the tool mandrel upward to expand the tubular while the slips are set.

28. A method of radially expanding a tubular, comprising:

providing a central tool mandrel with a fluid passageway therein;

providing a downhole actuator including a plurality of pistons each supported on one of the tool mandrel and the outer sleeve and sealed to the other of the tool mandrel and the outer sleeve;

positioning a tubular expander on a lower end of the tubular;

providing slips above the tubular expander for engaging the tubular;

running the tubular and the tubular expander in a well;

the tubular expander having a radially outermost surface positioned below a lower end of the tubular, the radially outermost surface having a diameter greater than the initial inner diameter of the tubular when run in the well, and a radially inner portion of the tubular expander being positioned radially within a portion of the downhole tubular when run in the well;

selectively rotating the work string to rotate the outer sleeve;

rotationally interconnecting the outer sleeve and the tool mandrel with one or more locking members, such that rotation of the outer sleeve rotates a bit at the lower end of the tool mandrel; and thereafter positioning the downhole actuator within the well for forcibly moving the expander axially within the downhole tubular, the downhole actuator generating an axially downward setting force on a setting sleeve surrounding the tool mandrel and connected to the work string to set the slips and generating an axially upward tensile force on the tool mandrel to radially expand the tubular.

29. The method as defined in claim 28, further comprising:

providing a right hand threaded connection along the tool mandrel for separating the tubular expander from the work string.

30. The method as defined in claim 28, further comprising:

powering the plurality of pistons to both move the setting sleeve downward to set the slips, and subsequently move the tool mandrel upward to expand the tubular while the slips are set.

* * * * *